US007442261B2

(12) United States Patent
Andersson et al.

(10) Patent No.: US 7,442,261 B2
(45) Date of Patent: Oct. 28, 2008

(54) IRON-BASE ALLOY CONTAINING CHROMIUM-TUNGSTEN CARBIDE AND A METHOD OF PRODUCING IT

(75) Inventors: Carl-Håkan Andersson, deceased, late of Göteborg (SE); by Mikael Andersson, legal representative, Göteborg (SE); by Henrik Andersson, legal representative, Vårgårda (SE); by Helena Andersson, legal representative, Alingsås (SE); Anders Nilsson, Malmö (SE); Jan-Eric Ståhl, Lund (SE)

(73) Assignee: Proengco Tooling AB, Staffan Storp (SE)

( * ) Notice: Subject to any disclaimer, the term of this patent is extended or adjusted under 35 U.S.C. 154(b) by 13 days.

(21) Appl. No.: 10/276,943

(22) PCT Filed: May 15, 2001

(86) PCT No.: PCT/SE01/01056

§ 371 (c)(1),
(2), (4) Date: Jul. 25, 2003

(87) PCT Pub. No.: WO01/88213

PCT Pub. Date: Nov. 22, 2001

(65) Prior Publication Data

US 2004/0028548 A1 Feb. 12, 2004

(30) Foreign Application Priority Data

May 16, 2000 (SE) ..... 0001785

(51) Int. Cl.
*C22C 38/28* (2006.01)
*C22C 38/18* (2006.01)
*C22C 33/06* (2006.01)

(52) U.S. Cl. ..... 148/207; 148/221; 148/225; 420/590

(58) Field of Classification Search ..... 75/236, 75/238, 240, 252, 566, 10.5; 419/15; 51/309
See application file for complete search history.

(56) References Cited

U.S. PATENT DOCUMENTS

| | | | | |
|---|---|---|---|---|
| 1,975,310 | A * | 10/1934 | Comstock | 420/129 |
| 4,053,306 | A | 10/1977 | Rodriguez | |
| 4,119,459 | A * | 10/1978 | Ekemar et al. | 75/243 |
| 4,365,997 | A * | 12/1982 | Jachowski et al. | 148/333 |
| 4,929,288 | A * | 5/1990 | Borges | 148/326 |
| 5,720,830 | A | 2/1998 | Wragg et al. | |
| 5,725,631 | A * | 3/1998 | Dorofeev et al. | 75/312 |

(Continued)

FOREIGN PATENT DOCUMENTS

EP 380715 A1 * 8/1990

(Continued)

*Primary Examiner*—Roy King
*Assistant Examiner*—Tima M McGuthry-Banks
(74) *Attorney, Agent, or Firm*—Boyle Fredrickson, S.C.

(57) ABSTRACT

In a method of producing an iron-based alloy containing chromium carbide, pieces of cemented carbide are added to an iron-based melt containing carbon, e.g. cast iron. Chromium, which regulates the solution of WC into the melt, is also added. The molten alloy is then cast. An alloy comprising chromium-tungsten-carbide in a ferrous matrix is produced. Uses of the alloy are claimed.

24 Claims, 3 Drawing Sheets

U.S. PATENT DOCUMENTS 5,803,152 A * 9/1998 Dolman et al. ..... 164/57.1
5,880,382 A * 3/1999 Fang et al. ..... 75/236

FOREIGN PATENT DOCUMENTS

GB 2298869 A * 9/1996
JP 48-084707 11/1973
JP 53-117655 10/1978
JP 57-118857 7/1982
JP 0 380 715 * 1/1989
JP 11-161227 12/2000
WO WO 84/04760 * 12/1984
WO WO 9845486 A1 * 10/1998

* cited by examiner

IRON-BASE ALLOY CONTAINING CHROMIUM-TUNGSTEN CARBIDE AND A METHOD OF PRODUCING IT

FIELD OF THE INVENTION

The present invention relates to a wear resistant metal material and a method for producing such a material, in particular a material suitable for use in products such as tools, machine elements or similar equipment, devised to be exposed to abrasive wear or chemical exposure.

BACKGROUND

Tools and machine elements of various kinds are used in a wide range of industries such as manufacturing, pulp, forest and steel industries as well as in different vehicle and defense applications.

Tool materials are usually divided into two groups depending on field of use; material for cutting and material for plastic and punching machining. Of the two fields of use, cutting tools are faced with the highest demands, such as e.g. cutting edge materials. This field of use demands a material with high wear resistance in combination with high toughness at elevated temperatures to obtain as high abrasion resistance as possible for a tool, i.e. high resistance towards abrasive wear.

Known tool materials are inter alia tool-steel, high-speed-steel and various cemented carbides. Tool-steel is used for simple hand held tools were only a good edge sharpness is required since the tool-steel requires low temperatures and reasonable forces during use.

High-speed-steel is alloyed steel with fairly high contents of carbon, chromium and wolfram, molybdenum and vanadium and in some cases even cobalt. High-speed-steel has high wear resistance while maintaining high hardness up to approximately 500° C., depending on the amounts of vanadium and wolfram.

Cemented carbides are the most common tool material because of the low production costs and are primarily made of wolfram carbide bonded together by cobalt. By varying the proportions of the constituents cemented carbides with material properties suitable for different areas of application can be obtained. By coating the cemented carbide with e.g. titanium carbide the wear resistance and therefore the tool life can be increased. Attempts to coat cemented carbides with a thin layer of synthetic diamond have also been made. To increase the properties of cemented carbides a material called cermets has been developed, a material with nickel instead of cobalt and titanium carbide or titanium-carbon-nitride instead of wolfram carbide. Cutting tools used for metal cutting have an optimal life span of 12-13 minutes, after which the wear mechanisms affect the cutting process and tolerances. The cemented carbide product can thereby be considered to have served its time. Wear mechanisms that affect the life span of a cutting edge are e.g. flank wear and chipping or nicking. Flank wear is a continuous loss of tool material through abrasive and adhesive wear. Chipping or nicking is a crack formation with subsequent fracture of the cutting edge.

Various ceramic materials exist which have good wear resistance and strength at elevated temperatures but have the drawback that they are brittle.

Material wise it has been impossible to manufacture materials with both high wear resistance and combinations of hardness and toughness, hence, compromises have been made. In simple applications the geometrical shape of the tool may for instance be designed in such a way that the tool exhibits acceptable wear resistance and strength.

Previous attempts have been made to design wear a resistant material, like the one suggested by the present invention, in which wolfram and carbon have been added to a white iron alloy. These attempts have however failed on account of the fact that the right proportions between wolfram and carbon, which decides the final properties of the material, are very difficult to obtain. Wolfram as a raw material is also quite expensive, a fact that has limited the development.

A traditional approach for manufacturing tools or other equipment includes the following steps:

Alloy ⇒ Casting ⇒ Plastic machining ⇒ Cutting ⇒ Hardening+annealing ⇒ Grinding ⇒ Finished part The Japanese-patent JP 2301539 discloses a method for manufacturing a Ni—Cr white iron comprising TiC and TiCN at which a material with high hardness and wear resistance is obtained.

In the European patent application EP 0 380 715 a composite material with high resistance to abrasive wear is disclosed. The composite material contains particles of cemented carbide, of which at least 70% have a grain size in the range of 2-15 mm, as well as white iron. The white iron alloy contains a complex carbide component to which an alloying element is added. Furthermore, the white iron alloy comprises 2.5 to 4.0% carbon and exhibits a Cr to C relation (Cr%/C%) in the range of 1-12. Furthermore, a way to produce the above mentioned composite is disclosed in the document, comprising the step of casting molten white iron around the cemented carbide particles.

In the U.S. Pat. No. 4,365,997 a compound material and a way to produce such a material is disclosed. The compound material contains a metal matrix, which includes cemented carbide grains with a size of between 0.1 mm and 5 mm. The metal matrix includes carbon, silicon, manganese, vanadium, chromium, wolfram, aluminum and iron. The cemented carbide comprises WC, $W_2C$, TiC, TaC or a mixture of these materials. The method for producing the above mentioned compound material is to add grains of cemented carbide to the molten metal matrix. The grains are encapsulated in a polymer-based matrix, which evaporates when the grains are added to the molten metal matrix, and subsequently the molten material solidifies.

Patent application WO 94/11541 announces a method for the manufacture of engineering ferrous metals such as cast iron and steel, which method includes adding to a molten engineering ferrous metal modified carbide particles, in solid state, and thereafter allowing the ferrous metal to solidify. The carbide particles are modified in the sense that they are covered with e.g. iron or a ferrous alloy so that the modified carbide particles receive a density equal to or close to the density of the ferrous metal. This density matching results in a uniform distribution of the carbide particles in the ferrous metal melt.

The Japanese patent JP 59104262 discloses a composite material with an inner steel layer and an outer layer comprising cast iron in which wolfram carbide particles or similar hard carbide particles have been evenly distributed. Furthermore, a method for producing such a material is disclosed. The method includes adding pre-heated carbide particles to molten cast iron and then casting the molten material around a pre-heated steel tube.

SE 185 935 relates to methods for alloying metal melts, predominantly including cast iron. In the document, an alloy, which can contain both chromium and wolfram, is mentioned, but nothing about any carbide structure.

EP 571 210 concerns the manufacture of a corrosion resistant alloy based on vanadium carbide. The material is created by e.g. the melting of a powder material.

SE 399 911 concerns the casting in of cemented carbide particles in iron based cast iron alloys. The suggested solutions is not intended to create melting and alloying, even though it is mentioned that alloys between the cast metal and the cemented carbide can occur and that these, generally speaking, are non advantageous. The patent does not describe the substitutional solution of wolfram in a chromium carbide structure.

DE 649 622 describes an alloy, which can contain both wolfram and chromium, but nothing of the interactions between the two during the formation of carbides.

GB 348 641 describes an alloy, which can contain both wolfram and chromium, but nothing of the interactions between the two during the formation of carbides.

OBJECT OF THE INVENTION

An object of the present invention is to provide a material for use in products or applications subjected to abrasive wear, and in particular a material more resistant to wear than previously known material in an unhardened state, as well as a method for producing such a material.

Another object of the invention is to provide a material in which the number of processing steps to finished product can be reduced. Since the number of processing steps to finished part is directly linked to the final cost of the product, the invention presents a cost efficient method to produce a wear resistant and high strength material.

Yet another object of the present invention is to provide a method for reusing worn-out cemented carbide.

SUMMARY OF THE INVENTION

According to the present invention the above mentioned objects are fulfilled by a method for manufacturing a metal material with high wear resistance, characterized by the steps of melting a base metal comprising iron and carbon; adding particles comprising a carbide component to the molten base metal, whereby said particles are dissolved in the base metal melt by way of diffusion; and casting the melt. Preferably the method includes the step of adding a solution limiting alloying component to the melt, which alloying component controls the solubility of the carbide component in the melt. The alloying component is carbide forming, whereby the properties in solid state for carbides based on said alloying component are improved by substitutional solution of said carbide component in the crystal formation for said carbides based on said alloying component (D). The carbide based alloying component (D) is however not soluble in the carbide component (E).

In one embodiment of the invention said particles are waste or surplus products originating from the production of cemented carbide products, which waste or surplus products comprise said carbide component. In a preferred embodiment said particles are added from a piece of worn-out cemented carbide product, comprising said carbide component, e.g. a worn-out cemented carbide cutting tool or a cemented carbide roller. The possibility to use worn-out cemented carbide products follows from the fact that the particles are dissolved by diffusion in the melt, whereby no machining of the particles which are to be added is required, in order to obtain a particular size or surface finish. Consequently, whole cemented carbide tools in size up to 40 mm and above can be added directly into the melt. This is economically advantageous, on the one hand because cemented carbide tools are worn-out quickly and are thus available in abundance, and on the other hand because this requires a minimum of processing steps. Another advantage with the use of waste or worn-out cemented carbide pieces is that the desired cemented carbide, e.g. WC, comprising wolfram and carbon, already is available in a balanced proportion, since they form molecular pairs in the carbide component.

In the added particles said carbide component is usually included with a grain size ≦10 μm, preferably 1-5 μm. If complete dissolution by diffusion of grains of said carbide component has not occurred, grains with a size of ≦10 μm may exist in the final material.

Before the dissolution of the particle in the melt said carbide component is prefarably bonded in said particle, or piece, by a metal material which gives melting at a lower melting point than the base metal. This material is preferably cobalt, but can also include nickel. The added solution limiting alloying component preferably includes chromium but can also include vanadium or molybdenum, and gives the final alloy an increased corrosion resistance as well as lowering the melting point of the melt in its molten state and lowering its surface tension. The base metal preferably includes stabilizing and supplementing alloying components like Si and Mn and constitutes in one embodiment white cast iron.

In a preferred embodiment of the invention said carbide component consists of wolfram carbide but can also include titanium carbide or niobium carbide. In one embodiment said carbide component is added to the melt in a melting furnace, in an amount of >5 weight-% of the final material, and is dissolved therein. In another embodiment said carbide component is added to the molten alloy, so that it comprises <15 weight-% of the final material, immediately prior to casting by an inoculation process, so-called super inoculation. This procedure differs from ordinary inoculation, where a material, arranged not to affect the constitution of the final material, is added in a very small dose. An inoculation substance can, for example, according to well-known technology, be added to a cast iron melt to act as nucleation points in order to achieve a finer grain microstructure. According to the super inoculation procedure of the invention a material, which is an essential part of the final alloy is added, and in an amount, which is of considerable importance for the final composition of the alloy. Said carbide component is included in the final material with between 5-40 weight-%, preferably 10-20 weight-%.

In one embodiment of the invention an additional alloying component is added to the melt, which additional alloying component facilitates the dissolution of said carbide component in the melt and decreases the carbon affinity. The additional alloying component is easily dissolvable in the molten alloy and does not affect the application properties of the final material. Furthermore, said additional alloying component contributes to an increased ability to anneal the final material by meta-stable states after casting. Preferably said additional alloy includes cobalt or nickel.

The final material is usable for the manufacture of compound materials by die casting or on casting on a core material. During on casting a protective gas or active gas is preferably provided in order to obtain a solution hardening effect. According to the invention, one way to achieve on casting is the use of induction heating of the core material prior to casting, and to carry out the on casting in a shell mould.

A product manufactured by the final material is, according to the present invention, usable in a recycling cycle, in which the product or a part of the product is added and dissolved in a melt of a base metal.

BRIEF DESCRIPTION OF THE DRAWINGS

Preferred embodiments of the present invention are described in detail below with reference to the accompanying drawings, in which.

DETAILED DESCRIPTION OF PREFERRED EMBODIMENTS

Figure 1:
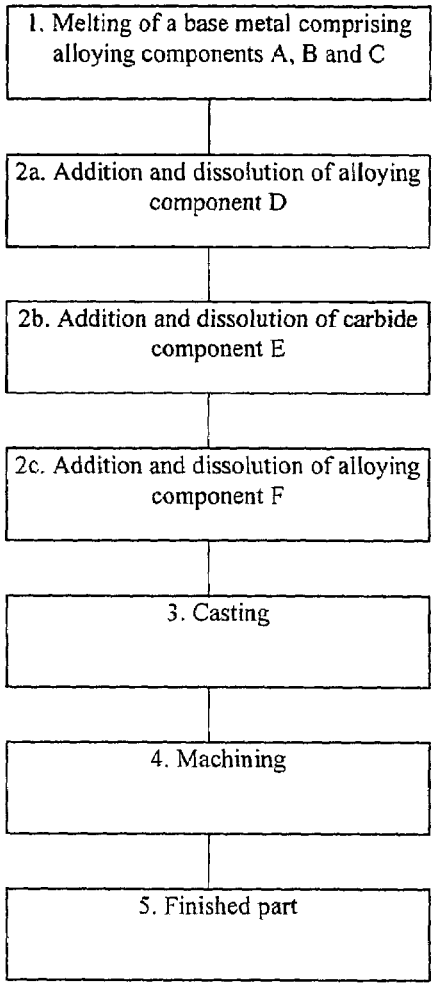
FIG. 1 shows a flow chart of a first method according to the invention.

The method according to the invention for producing a wear resistant and durable material, so-called carbide steel, can be described in the following steps (FIGS. 1 and 2):

1. Alloying
   - a. production of a base alloy; including
     - a base metal containing
       - an alloying component A, such as iron;
       - an alloying component B comprising stabilizing and supplementing alloying components, such as silicon and manganese;
       - an alloying component C, such as carbon;
     - an alloying component D comprising a solution limiting alloying component, such as chromium, vanadium or molybdenum; and
   - b. melting and adding of a carbide component E, such as wolfram carbide, titanium carbide or niobium carbide, and possibly adding of an other alloying component F, such as cobalt or nickel;
2. Casting; and
3. Machining.

1. Alloying

The base material in the method according to the invention is a base metal including iron A, stabilizing and supplementing alloying component B, e.g. silicon and manganese and an alloying component C, e.g. carbon. A base alloy is obtained by complementing the base metal with a solution limiting alloying component D, preferably chromium, but vanadium or molybdenum can be used.

The alloying component D should fulfill the following functions:

- in molten state, to lower the melting point and lower the surface tension of the base alloy and limit the solubility of other materials in the base alloy; and
- in solid state, to be a property enhancing component of the final alloy, the so-called carbide steel, by the formation of carbides so that carbides with desired properties are formed, having an electrochemical potential contributing to corrosion limiting properties.

During the alloying stage alloying component D is devised to limit the solubility and the speed of dissolution of carbide component E in the molten base alloy. The carbide component E is preferably added as wolfram carbide, but also e.g. titanium carbide or niobium carbide can be added. The carbide component E is pre-heated to minimize under-cooling of the base alloy before more than 5-% by weight of the carbide component E is added to the molten base alloy. Because of alloying component D the added carbide component E is only dissolved to such an extent permitted by alloying component D. This way the manufacturer can control the solubility of the carbide component E and a desired part of carbide component E can therefore constitute un-dissolved particles in the final alloy. With regard to desired properties of the finished carbide steel more than one carbide component can be added.

Carbide component E is soluble in alloying component D, but the reverse relation does not apply, i.e. single sided solubility exists. This is especially advantageous since the carbide steel then exhibits a large eutectic interval, i.e. an interval within which the carbide steel exhibits a lower melting point than the pure metals each do. The size of the interval depends on chosen carbide component and base alloy. As the molten alloy solidifies two or more solid phases simultaneously precipitate which gives an alloy with very good material properties and castability. Thus, the single sided solubility enhances the castability within a large interval of composition.

An additional alloying component F can be added to the molten alloy to further ease the dissolution of the added carbide component E in the molten alloy. Components that decrease the carbon affinity can for example be preferred. Preferably cobalt is used, but also nickel or aluminum can be suitable. The alloying component F should only be added to a limited extent and be easily dissolvable in the molten alloy in order not to affect the unique properties of the final alloy too much. The alloying component F further adds to an increased hardenability by meta-stable conditions after casting.

Under controlled conditions there are no obstacles against integrating steps 1*a* and 1*b* above for the manufacturing of the carbide steel according to the invention. Some weight-%, less than 15 weight-%, of carbide component E, e.g. wolfram carbide, is advantageously added to the molten alloy immediately prior to casting. This inoculation process, so-called super inoculation, then takes place to such an extent that notable changes in composition as well as extra grain formation points are obtained, for the purpose of giving a finer microstructure as well as improving the material properties by an increased amount of carbides.

An example of a suitable base alloy for step 1*a* above is a white cast iron alloy type SS0466. A typical white cast iron alloy can in its original composition consist of at least 2.9 weight-% carbon, 0.7 weight-% silicon, 0.4 weight-% manganese, 18 weight-% chromium, 1.0 weight-% nickel, 0.3 weight-% titanium and the remaining part iron.

White cast iron can then be alloyed with a worn-out cemented carbide component which has served its time (step 1*b* above), in which the carbon balance for the modified white iron alloy is not changed compared with its original composition, since the method according to the invention allows a release of the carbon content for the alloying components bonded to re-created carbides during the solidification of the molten alloy.

In one embodiment of the final material, i.e. the alloy according to the invention, the alloy comprises, in weight-%, 1-5% carbon, 10-40% chromium, 2-40% wolfram and the balance iron and other alloying components. Preferably said other alloying components comprise, in weight-%, 0.5-2% silicon, 0.3-10% manganese, 0-7% nickel, 0-2.5% titanium, 0-5% molybdenum and 0.1-15% cobalt.

In one embodiment of the alloy according to the present invention the alloy includes, in weight-%, 2-3.5% carbon, 20-30% chromium, 5-20% wolfram and the balance iron and other alloying components. The mentioned other alloying components are preferably, in weight-%, 0.8-1.2% silicon, 0.4-2% manganese, 0.8-2% nickel, 0.2-0.5% titanium, 0-1% molybdenum and 0.5-5% cobalt.

In one embodiment of the alloy according to the invention, said other alloying components amount to, in weight-%, 0-5%. The final material predominantly comprises a structure of chromium carbide, which has been formed during the solidification of the melt by the strongly carbide-forming chromium atoms, which have bonded carbon atoms in a lattice structure. Since these chromium carbides dissolves wolfram carbide, a material according to the invention is obtained in which wolfram is substitutionally dissolved in the lattice crystal of the chromium carbide structure, wherein complex carbides based on chromium and wolfram are obtained.

In table 1 below the chemical composition, the bulk analysis, of one embodiment of the carbide steel according to the present invention, comprising 15 weight-% cemented carbide (WC—Co), is shown. The presented level reflects the chemical composition of the particular sample exhibited at the analysis.

TABLE 1

Chemical composition in weight-%, the bulk analysis, of one embodiment KS15(3) of the material according to the present invention.

| Fe | Cr | W* | C | Si | Mn | Ni | Ti | Mo | Co | Al | P | S |
|---|---|---|---|---|---|---|---|---|---|---|---|---|
| 62.0 | 23.97 | 9.30 | 2.70 | 1.76 | 0.255 | 0.341 | 0.115 | 0.085 | 0.760 | 0.010 | 0.044 | 0.048 |

*Analyzed with XRF

However, during casting, iron scrap comprising more or less of certain alloys, is advantageously used, wherein the above mentioned material can be considered a sample of an embodiment with 15 weight-% WC—Co, characterized by the range of composition, in weight-%, 2.5-3.5% carbon, 8-12% wolfram, 20-28% chromium, 1.6-2.0% silicon, 0.2-0.4% manganese, 0.3-0.5% nickel, 0.1-0.2% titanium, 0-0.7% molybdenum and 0.5-1.0% cobalt.

Figure 3:
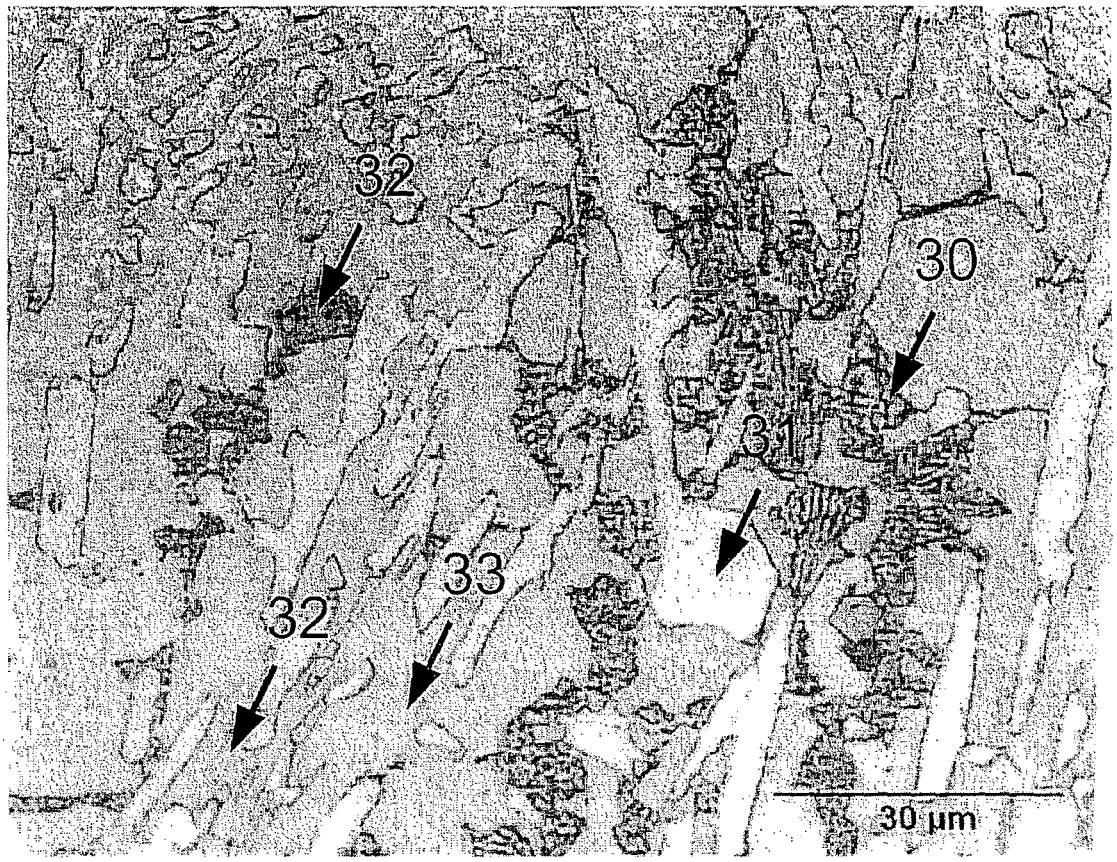
FIG. 3 shows the microstructure for one embodiment of the material according to the present invention.

In FIG. 3 the microstructure and the structural components of an alloy according to the present invention, in an embodiment comprising 15 weight-% cemented carbide (WC—Co), is shown. The arrows in the figure indicate: 30—eutecticum, 31 —chromium carbide, 32—complex carbide with wolfram dissolved in the chromium carbide and titanium carbide, and 33—matrix. From the figure it is evident that the WC particles or pieces added to the melt cannot be localized in the microstructure of the material according to the present embodiment, because of the dissolution obtained of said particles or pieces in the melt, e.g. in an induction melting furnace.

Figure 4:
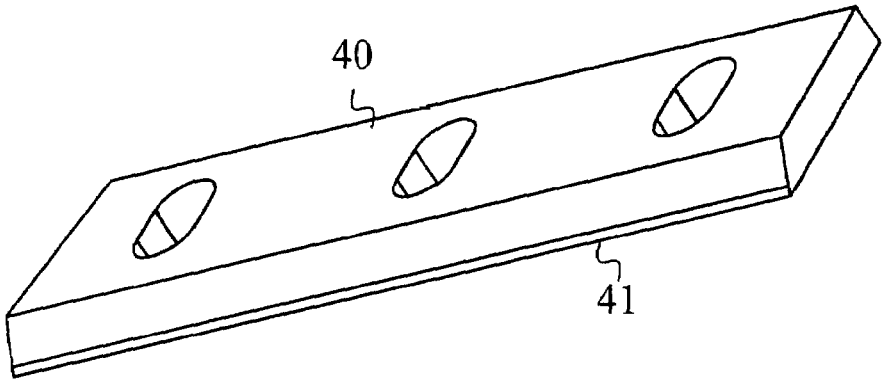
FIG. 4 shows a cutting element, which may advantageously be manufactured in the material according to the present invention.
Figure 5:
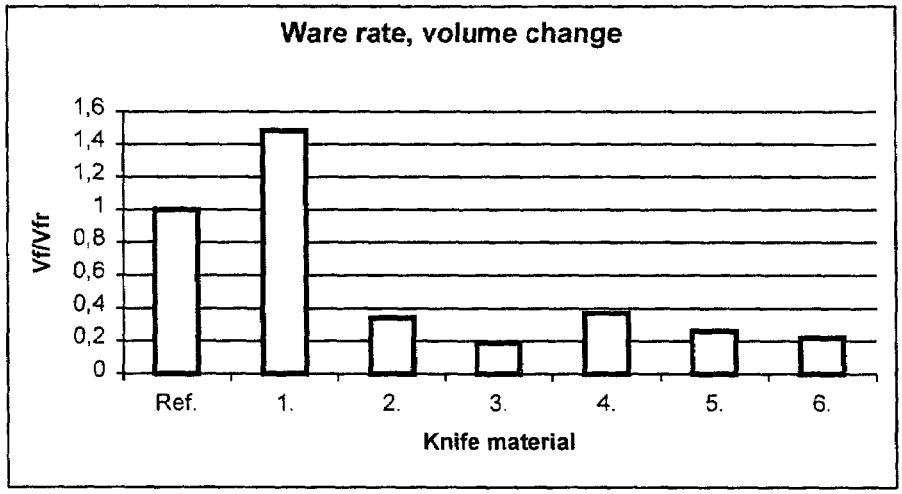
FIG. 5 shows a diagram showing the wear resistance for different embodiments of the present invention, as well as for some known materials.

In FIG. 4 an application of the material according to the present invention is shown, in a product shaped as a granulator knife 40, devised with a cutting edge 41. Industrial trials with granulator knifes cast in an alloy according to the present invention, in an embodiment comprising 5 weight-% and 15 weight-% cemented carbide (WC—Co), have shown large differences in wear resistance, compared to a standard tool material SS2310 (SS indicates Swedish Standard). Also the weight-% WC has been shown to affect the wear resistance. FIG. 5 illustrates a diagram showing the results from granulation of PVC during one month of production conditions. In the diagram the wear resistance is shown as the change in volume of the cutting edge of the knife compared with reference SS2310, a common tool material. On the horizontal axis different knife materials are indicated, were Ref is the standard tool-steel SS2310. Furthermore, 1 is a white iron alloy SS0466, a well known material. Knife material 2 indicates an alloy according to the present invention, called carbide steel KS5(1), with 5 weight-% cemented carbide (WC—Co). Knife material 3 is another alloy according to the invention, called carbide steel KS15(1), manufactured with 15 weight-% cemented carbide (WC—Co). Both material 3 and 4 are based on said white iron alloy SS0466. The differences between the materials according to the invention, in the embodiments 2 and 3, and the known materials Ref and 1, are striking.

Furthermore, in FIG. 5 the result of a more advanced white iron 4, SS0466BTI, containing a certain amount of titanium, is shown. This material is considerably more wear resistant than the reference. Despite this, an alloy according to the invention based on this titanium containing white iron alloy SS0466BTI will have an even more increased wear resistance. Knife material 5 indicates an alloy according to the invention called carbide steel KS(BTI)5(1), manufactured with 5 weight-% cemented carbide (WC—Co), and knife material 6 indicates an alloy carbide steel KS(BTI)15(1) with 15 weight-% cemented carbide (WC—Co). The later alloy in particular has a wear resistance, which is 5-6 times better than the reference, and SS0466BTI.

The alloying levels can under certain conditions be adjusted so that a toughness adjustment can be carried out by the precipitation of secondary complex carbides by means of annealing. Trials have also shown that it is possible to carry out a localized heat treatment based on induction technology. A toughness optimization of e.g. the edge or other areas of the tool or product can therefore be carried out. For known heat conduction properties and known transformation conditions localized heat treatment can be realized by controlling the cooling gradient by control of boundary conditions. For more complicated devices a technology based on finite element analysis (FEA) can provide an important tool for this type of heat treatment.

Studies carried out unambiguously show that as-cast products of the final alloy, the carbide steel, according to the invention, can be machined with modem and advanced cutting tool material at most competitive prices in comparison with martensitic materials, on condition that optimal cutting data combination are chosen. Already at rough machining a unique surface finish has been obtained.

The method according to the invention makes it possible to reuse a worn-out product, made of the alloy according to the invention. This recycling system can on the one hand be based on a direct re-melting and recasting of the product for use in new products, and on the other hand as a base alloy, in which further amounts of the alloying components can be added for the manufacture of a new melt according to the invention. Furthermore, a return system can be based on worn-out tool material, preferably cemented carbide, included in a recycling cycle for the manufacture of an alloy according to the invention. This recycling procedure is possible because the molten alloy, completely or partly is saturated with carbides or carbide forming alloying elements D and E.

For example, a white iron alloy modified according to the invention, can obtain a hardness of 660hardness Brinell (HB) at an addition of 15 weight-% carbide component E and 650HB at an addition of 5 weight-% carbide component E. These hardness values should be compared with the maximum hardness of 550 HB, which a white iron alloy can obtain in its as-cast state.

According to the present invention an extremely wear resistant material, so-called carbide steel, can be obtained from a white iron alloy according to the above with a suitable portion of carbide component E. The carbide steel has for its field of use a favorable ratio between hardness and toughness, and wear resistance, without the need of subsequent heat treatment. The favorable properties of the carbide steel are received after controlled solidification and cooling. In the applications for which the carbide steel according to the invention is adapted, no annealing is necessary. If the carbide steel is annealed a tougher material is obtained.

By the term high alloy white iron is here meant a castable iron alloy including more than 3 weight-% of other alloying components than those that made part of the base metal. Such high alloy white irons are well suited for use in applications exposed to abrasive wear. The reason for this is that a large portion of the carbon is bonded as carbides, giving the alloy a high hardness and good chances to withstand degradation concerning both geometry and structure. The carbides are imbedded in a matrix with a structure which, depending on the composition, can be adjusted to achieve optimum relation between wear resistance and toughness. High alloy white iron contains high levels of chromium, which stabilises the carbides in the microstructure of the matrix and prevents graphite from being precipitated during solidification. White cast iron is characterised by a chemical compound of iron carbide, such as cementite, $Fe_3C$, in a base material of, depending on the amount of chromium, ferrite, pearlite, austenite and/or martensite. High levels of chromium in high alloyed white iron means complete or partly pearlitic matrix, where the amount of complex carbides controls the wear resistance of the alloy. The micro hardness for the chromium carbide is between 840 and 1400 hardness Vickers (HV) (HV50), depending on the chromium to carbon relation in the composition of the alloy. Present chromium carbides in white iron alloys having a high amount of chromium may include $M_3C$ 840-1100 HV (HV50), $M_7C_3$ 1200 to 1800 HV (HV50) and/or $Mo_2C$ 1500 HV (HV50). Low ratios between chromium and carbon result in a matrix of austenite that can be transformed into pearlite during cooling. The wear resistance can be further increased by heat treatment of several white iron alloys so that the matrix is transformed into martensite.

2. Casting

When carbide steel is manufactured according to the method according to the invention the material is cast in order to obtain a final product with desired shape. By controlling the cooling of the molten alloy the hardness of the carbide steel can be controlled, i.e. rapid cooling results in lower hardness whereas a lower cooling speed gives a carbide steel with higher hardness. This property is unique for the carbide steel according to the invention with the consequence that the carbide steel exhibits unique heat-treating properties, i.e. an adjustment of hardness and toughness can be done depending on application. The carbide steel according to the invention exhibits a case depth, which is essentially identical through a section of a cast product. Normally a thick cast white iron alloy would exhibit a lower hardness at the center of the material, as this solidifies last, compared with the hardness of the surface because of different cooling speeds. This may mean that a desired microstructure (with accompanying mechanical properties and hardness) is not achieved throughout the entire cast product.

3. Machining

A finishing cut of the final product is carried out by machining of the surfaces of the final product in order for it to fulfill the tolerances that the application demands.

The carbide steel manufactured according to the invention has, when used in tools, exhibited a life expectancy range of up to five times the life expectancy range of comparable materials.

Further Developments

A further development of the method according to the present invention applies to the use of the carbide steel during the manufacture of so-called compound materials. The carbide steel is then cast in or on together with a light alloy or a steel alloy in which the carbide steel basically maintains its mechanical properties in contrast to martensitic steel. This means that the carbide steel can be used in hot applications or methods of production up to 900° C. without any mentionable change in the microstructure due to the stable microstructure of the carbide steel. In casting in a light metal can be carried out for example by die-casting, whereas on casting with steel with higher toughness can be carried, inter alia, out by casting with shell moulds. On casting can be carried out by preheating of e.g. steel plates in a cast mould by induction heating followed by the filling of the mould by the carbide steel. This casting can be carried out with various types of surrounding protective atmospheres, e.g. protective gas or active gas, which can give a solution hardening effect and thereby creating a more even transition between a though and hard material.

The proposed technology for the manufacture of so-called compound steel components is of great interest within different fields of applications where a combination of toughness and hardness, alternatively toughness and high wear resistance is desired. Such a compound material solution can be of interest also with respect to following machining. For example, the wheel center of a pump wheel can be manufactured by tool steel with good machinability while the rest of the pump wheel is manufactured from carbide steel according to the invention. In the same fashion can e.g. the "core material" in a stirrer (pump wheel/impeller) be manufactured by choosing a tougher steel, while the parts exposed to abrasive wear are made of carbide steel according to the present invention.

By in casting of carbide steel reinforcements can be received in a light metal alloy. Parts of the reinforcements can extend to the edge of the light metal component whereby a high wear resistance or load-bearing ability is obtained. This design is not possible in a martensitic steel alloy because of the annealing effects, which arise during casting.

In FIG. 1 the process steps according to the invention are illustrated by in flow chart. In step 1 a melt of a base metal is provided, which base metal includes iron A, stabilizing component B, e.g. silicon and/or manganese, and carbon C.

In what is described as step 2 more additives are added. In step 2*a* a solubility limiting alloying component D, e.g. chromium, is added. The melt of the base metal and alloying component D is referred to as the base alloy, and in the case that an already existing material has the desired composition of components A-D according to the base alloy, step 2*a* can be excluded.

Component D is arranged to limit the solubility of carbide component E, which is added to the melt in step 2*b*. The carbide component E is e.g. wolfram carbide bonded by cobalt, and can be added as powder or as pieces of used or worn-out cemented carbide products.

In step 2*c* an additional alloying component F, e.g. cobalt or nickel with advantageous properties according to the above, can be added if so desired. It is obvious that the order of steps 2*a*-2*c* is not critical and they can be carried out simultaneously since the added components are to be dissolved in the melt.

According to the embodiment described in FIG. 1, the final material, also called the final alloy, is then cast in step 3. After cooling, the material is ready to be machined, in step 4, into a final part, step 5.

Figure 2:
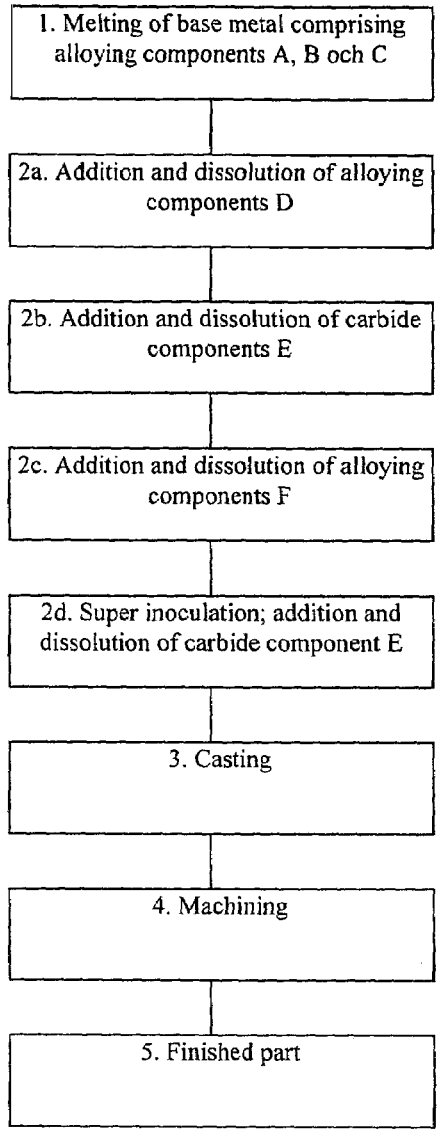
FIG. 2 shows a flow chart of a second method according to the invention, comprising a super inoculation process.

Another embodiment of the invention, illustrated in FIG. 2, includes the steps described in FIG. 1 and with step 2*d* added. In this step the new super inoculation step is carried out during which a to the composition significant component, carbide component E, is added in an amount of considerable importance to the composition of the final material, immediately prior to casting. This amount can correspond to a part of the final alloy of up to 15 weight-%, but preferably <5 weight-%.

The present invention has been described by means of preferred embodiments, and it is evident for a person skilled in the art that modifications thereof can be carried out without leaving the scope of the attached claims.

The invention claimed is:

1. A method for producing a high wear resistance alloy comprising the steps of:

melting an existing known base white cast iron alloy having a known composition and a certain iron and carbon content;

adding carbon to the base white cast iron melt in the form of pieces comprising tungsten carbide for complete dissolution by diffusion and thereby increasing the carbon content of the base alloy melt, the tungsten carbide providing a known content relation between tungsten and carbon;

adding chromium to said base alloy in an amount sufficient for controlling the solubility of tungsten carbide in the base alloy melt and for providing material for carbide formation; and casting the resulting alloy melt and thereby forming a final alloy with an additional precipitated carbide structure comprising chromium and the carbon added in the form of tungsten carbide, wherein tungsten is substitutionally dissolved in the lattice structure of said chromium carbide structure.

2. The method according to claim 1, wherein said pieces are added to the melt in the form of a worn-out cemented carbide product comprising tungsten carbide.

3. The method according to claim 2, wherein each one of said pieces comprises a worn-out cemented carbide cutting tool insert.

4. The method according to claim 1, wherein at least one of said pieces is comprised of cemented carbide added to the melt in the form of a waste or surplus product from a manufacture of a cemented carbide product, wherein the waste or surplus product is comprised of tungsten carbide.

5. The method according to claim 1, wherein each one of said pieces of tungsten carbide comprise cemented carbide, have a size less than forty millimeters, and have tungsten carbide grains that each have a grain size no greater than ten micrometers.

6. The method according to claim 5 wherein any non-dissolved grains of tungsten carbide, after the solidification of the melt, has a grain size of no greater than ten micrometers.

7. The method according to claim 1, wherein the tungsten carbide, prior to dissolution in the melt, is bonded with a metallic material, which provides a lower melting point than the base metal.

8. The method according to claim 7, wherein said metallic material in which the tungsten carbide is bonded, is cobalt.

9. The method according to claim 1, wherein the chromium, when in a in molten state in the melt, lowers the melting point of the melt and decreases the surface tension of the melt.

10. The method according to claim 1, wherein said base cast iron alloy further comprises stabilizing and supplementing alloying components Si and Mn.

11. The method according to claim 1, wherein tungsten carbide is added to the melt in an amount that makes up at least five percent by weight of the formed alloy.

12. The method according to claim 1, wherein tungsten carbide is added immediately prior to the casting step using a super inoculation process in an amount sufficient to make up less than fifteen percent by weight of the formed alloy.

13. The method according to claim 1, wherein an amount of tungsten is included such that it makes up between five and forty percent by weight of the formed alloy.

14. The method according to claim 1, wherein an additional alloying component is added to the melt, which additional alloying component facilitates the dissolution of the tungsten carbide in the melt.

15. The method according to claim 14, wherein said additional alloying component is easily dissolved in the molten alloy and does not affect the final application properties of the final material.

16. The method according to claim 14, wherein said additional alloying component contributes to an increased hardenability of the final material by meta-stable states after casting.

17. The method according to claim 14, wherein said additional alloying component comprises cobalt or nickel.

18. The method according to claim 1 wherein during the casting step, the resulting alloy melt is on cast on a core material or die cast.

19. The method according to claim 18, wherein during on casting, a protective or active gas is added in order to achieve a solution hardening effect.

20. The method according to claim 18, comprising the additional steps of:

induction heating of the core material prior to on casting; wherein on casting is carried out in a shell mould.

21. The method according to claim 1, wherein a product manufactured from the final alloy is used in a re-cycling process such that it is added and dissolved in a melt of a subsequent base cast iron alloy.

22. A method for producing a high wear resistance alloy comprising the steps of:

melting an existing known base white cast iron alloy having a known composition and a certain iron and carbon content;

adding carbon to the base white cast iron melt in the form of pieces comprising tungsten carbide for complete dissolution by diffusion and thereby increasing the carbon content of the base alloy melt, the tungsten carbide providing a known content relation between tungsten and carbon;

adding chromium to said base alloy for controlling the solubility of tungsten carbide in the base alloy melt and for providing material for carbide formation; and casting the resulting alloy melt and thereby forming a final alloy with an additional precipitated carbide structure comprising chromium and the carbon added in the form of tungsten carbide, wherein tungsten is substitutionally dissolved in the lattice structure of said chromium carbide structure, and wherein the resulting high wear resistance alloy comprises by weight 2-3.5% carbon, between 5% and 20% tungsten, and between 20% and 30% chromium, the balance being iron and other alloying components.

23. A method for producing a high wear resistance alloy comprising the steps of:

melting an existing known base cast iron alloy having a known composition and a certain iron and carbon content;

adding carbon to the melt by adding pieces to the melt each in the form of waste, surplus or worn-out cemented carbide product comprised of tungsten carbide providing a known tungsten to carbon ratio for complete dissolution by diffusion therein and thereby increasing the carbon content thereof;

adding chromium to the melt in an amount sufficient to control the solubility of the tungsten carbide added to the melt and to provide material for carbide formation; and casting the resulting melt with the resulting alloy comprised of a precipitated carbide structure that includes chromium from the added chromium and carbon from the added tungsten carbide forming a lattice chromium carbide structure that is further comprised of substitutionally dissolved tungsten from the added tungsten carbide.

24. A method for producing a high wear resistance alloy comprising the steps of:

melting white cast iron alloy having a known composition and a certain iron and carbon content;

adding carbon to the base white cast iron melt in the form of pieces of waste, surplus, or worn-out products that are comprised of tungsten carbide for complete dissolution by diffusion and thereby increasing the carbon content of the base alloy melt, the tungsten carbide providing a known content relation between tungsten and carbon;

adding chromium to said base alloy for controlling the solubility of tungsten carbide in the base alloy melt and for providing material for carbide formation; and casting the resulting alloy melt and thereby forming a final alloy with an additional precipitated carbide structure comprising chromium and the carbon added in the form of tungsten carbide, wherein tungsten is substitutionally dissolved in the lattice structure of said chromium carbide structure, and wherein the resulting high wear resistance alloy comprises by weight 2.5-3.5% carbon, between 8-12% tungsten, and between 20-28% chromium, the balance being iron and other alloying components.

* * * * *